US011440708B2

(12) United States Patent
Simonds et al.

(10) Patent No.: US 11,440,708 B2
(45) Date of Patent: Sep. 13, 2022

(54) TAMPER/CHILD-RESISTANT DISPENSER

(71) Applicant: Ventiv Design, LLC, Union, NJ (US)

(72) Inventors: Jack Simonds, New York, NY (US); Alex Margetts, Lichfield (GB); Michael Cohen, New York, NY (US); Adam Israeli, Short Hills, NJ (US); Robert Israeli, Short Hills, NJ (US)

(73) Assignee: Ventiv Design, LLC, Union, NJ (US)

( * ) Notice: Subject to any disclaimer, the term of this patent is extended or adjusted under 35 U.S.C. 154(b) by 0 days.

(21) Appl. No.: 17/586,016

(22) Filed: Jan. 27, 2022

(65) Prior Publication Data

US 2022/0242626 A1 Aug. 4, 2022

Related U.S. Application Data

(60) Provisional application No. 63/144,697, filed on Feb. 2, 2021.

(51) Int. Cl.
*B67B 1/00* (2006.01)
*B65D 50/04* (2006.01)
(Continued)

(52) U.S. Cl.
CPC ..... *B65D 50/045* (2013.01); *B05C 17/00506* (2013.01); *B65D 47/305* (2013.01); *B65D 50/041* (2013.01)

(58) Field of Classification Search
CPC .. B65D 50/045; B65D 47/305; B65D 50/041; B05C 17/00506
See application file for complete search history.

(56) References Cited

U.S. PATENT DOCUMENTS 3,590,691 A * 7/1971 Magers ..... B05B 11/3059 222/402
3,738,536 A 6/1973 Gach
(Continued)

OTHER PUBLICATIONS

Non-Final Rejection dated Dec. 5, 2019, U.S. Appl. No. 16/443,412 (abandoned).

(Continued)

*Primary Examiner* — Paul R Durand
*Assistant Examiner* — Bob Zadeh
(74) *Attorney, Agent, or Firm* — Lawrence B. Goodwin; Mandelbaum Barrett PC

(57) ABSTRACT

A tamper-resistant nozzle assembly for preventing the unwanted or unintentional dispensing of a material from a container. The nozzle assembly may comprise a base adapted to fit on top of a container holding the material, a mechanism located within the base and configured to provide tamper-resistant properties for the nozzle assembly, a nozzle connected to the base and having a pair of diametrically opposed tabs extending downwardly therefrom into the base, the tabs being capable of travelling radially inward when squeezed by a user, whereby, in a locked state, the mechanism limits the travel of the tabs such that (1) the nozzle cannot rotate relative to the base, and (2) the nozzle cannot be depressed to release the material from the container. When a user squeezes the tabs, the mechanism is in an unlocked state and permits the rotation of the nozzle relative to the base, to thereby enable the nozzle to be depressed relative to the base to allow it to dispense the material from the container.

12 Claims, 4 Drawing Sheets

(51) Int. Cl.
*B65D 47/30* (2006.01)
*B05C 17/005* (2006.01)

(56) References Cited

U.S. PATENT DOCUMENTS 4,328,911 A 5/1982 Knickerbocker
4,366,921 A 1/1983 Kirk, Jr.
4,368,830 A * 1/1983 Soughers ..... B05B 11/306 222/384
4,991,746 A * 2/1991 Schultz ..... A47K 5/1205 222/321.3
6,045,008 A * 4/2000 Gonzalez Fernandez ..... B05B 11/3074 222/321.9
9,480,802 B2 * 11/2016 Barber ..... B05B 11/3059
2003/0038146 A1 * 2/2003 Meshberg ..... B05B 11/3059 222/321.9
2005/0035154 A1 * 2/2005 Meshberg ..... B05B 11/3059 222/153.13
2007/0080174 A1 * 4/2007 Coe ..... B05B 11/3059 222/153.13
2011/0297700 A1 * 12/2011 Santagiuliana ..... B05B 11/3053 222/336
2012/0292344 A1 * 11/2012 Bertin ..... B05B 11/0032 222/384
2014/0097207 A1 * 4/2014 Szymiczek ..... B05B 11/0032 222/153.13
2014/0252038 A1 * 9/2014 De Rosa ..... B65D 47/2087 222/525
2015/0328651 A1 * 11/2015 Hohmann ..... B05B 11/3077 604/192

OTHER PUBLICATIONS

List of References cited in U.S. Appl. No. 16/443,412 (abandoned).

* cited by examiner

TAMPER/CHILD-RESISTANT DISPENSER

REFERENCE TO RELATED APPLICATION

The present invention claims the benefit of the filing date of Provisional Application Ser. No. 63/144,697, filed Feb. 2, 2021, the entire disclosure of which is hereby incorporated by reference.

FIELD OF THE INVENTION

The present invention relates to the field of tamper/child-resistant dispensers, and in particular, to a tamper/child resistant pump for dispensing an aerosol, cream, liquid or gel.

BACKGROUND

Certain governmental regulations require that particular products be packaged in containers equipped with child-resistant closures. Examples of such products may include medications, corrosive materials, certain cleaning compositions, disinfectants, insecticides and numerous other products which, when ingested by or exposed to children, could cause injury. In other instances, even when the product is not particularly dangerous, it can be useful to have a closure that prevents the unintentional opening of the container, for example, during transport, to prevent spillage or unintentional discharge of the contents.

Although the prior art has examples of tamper/child resistant containers, often the construction of such prior art containers can be expensive, complicated and limited in its application to special purpose containers. Further, many prior art solutions to this problem are specifically limited to either aerosols, creams, gels or liquids, but not to all of such applications. On the other hand, simpler, less expensive prior art constructions, which may have been used in a wider variety of applications, have often times have not been as effective as desired to prevent unintentional use.

SUMMARY OF THE INVENTION

It is therefore an object of this invention to provide a tamper/child-resistant dispenser that is inexpensive, requiring essentially the addition of only two or three plastic parts to a standard dispenser, which can be used with a variety of materials, including medications, aerosols, creams, gels and liquids, and which is highly effective in preventing unintentional use.

In accordance with one aspect of the invention, tamper-resistant nozzle assembly is provided for preventing the unwanted or unintentional dispensing of a material from a container. The nozzle assembly may comprise a base adapted to fit on top of a container holding the material, a mechanism located within the base and configured to provide tamper-resistant properties for the nozzle assembly, a nozzle connected to the base and having a pair of diametrically opposed tabs extending downwardly therefrom into the base, the tabs being capable of travelling radially inward when squeezed by a user, whereby, in a locked state, the mechanism limits the travel of the tabs such that (1) the nozzle cannot rotate relative to the base, and (2) the nozzle cannot be depressed to release the material from the container. When a user squeezes the tabs, the mechanism is in an unlocked state and permits the rotation of the nozzle relative to the base, to thereby enable the nozzle to be depressed relative to the base to allow it to dispense the material from the container. The mechanism may comprise a pair of tracks along which the tabs can travel to rotate the nozzle between the locked and unlocked states, and a pair of projections preventing the tabs from travelling along the tracks to prevent the nozzle from rotating from the locked state to the unlocked state. The mechanism can further include a pair of notches adapted to allow the tabs to move vertically to thereby allow the nozzle to dispense the material from the container in the unlocked state.

In accordance with another aspect of the invention, a tamper-resistant dispenser is provided for preventing the unwanted or unintentional dispensing of a material from a container. The dispenser includes a container for holding the material, a nozzle connected to the container, a pump adapted to be in functional communication with the material and adapted to dispense the material through the nozzle when activated, and a mechanism interacting with the nozzle such that, in a first state, the mechanism prevents the nozzle from dispensing the material, and which, in a second state, enables the nozzle to dispense the material by allowing the nozzle to activate the pump. The nozzle may include at least one tab adapted to be engaged by a user to allow the nozzle to rotate from the first state to the second state. The tab is adapted to be pushed radially inward by the user to allow the user to rotate the nozzle between the first and second states. The mechanism may comprise a track along which the tab can travel to rotate the nozzle between the first and second states, and a projection preventing the tab from travelling along the track to prevent the nozzle from rotating from the first state to the second state. The mechanism may further include a notch adapted to allow the tab to move vertically to thereby allow the nozzle to activate the pump in the second state. Preferably, the nozzle includes a pair of diametrically opposed tabs adapted to be squeezed by the user to allow the nozzle to selectively rotate from the first state to the second state, and the mechanism comprises a pair of tracks along which the tabs can travel to rotate the nozzle between the first and second states, and a pair of projections preventing the tabs from travelling along the tracks to prevent the nozzle from rotating from the first state to the second state. Finally, the mechanism can further include a pair of notches adapted to allow the tabs to move vertically to thereby allow the nozzle to activate the pump in the second state.

BRIEF DESCRIPTION OF THE DRAWINGS

These and other objects and aspects of the present invention will be described with reference to the following drawing figures, of which

DETAILED DESCRIPTION OF THE INVENTION

Figure 1:
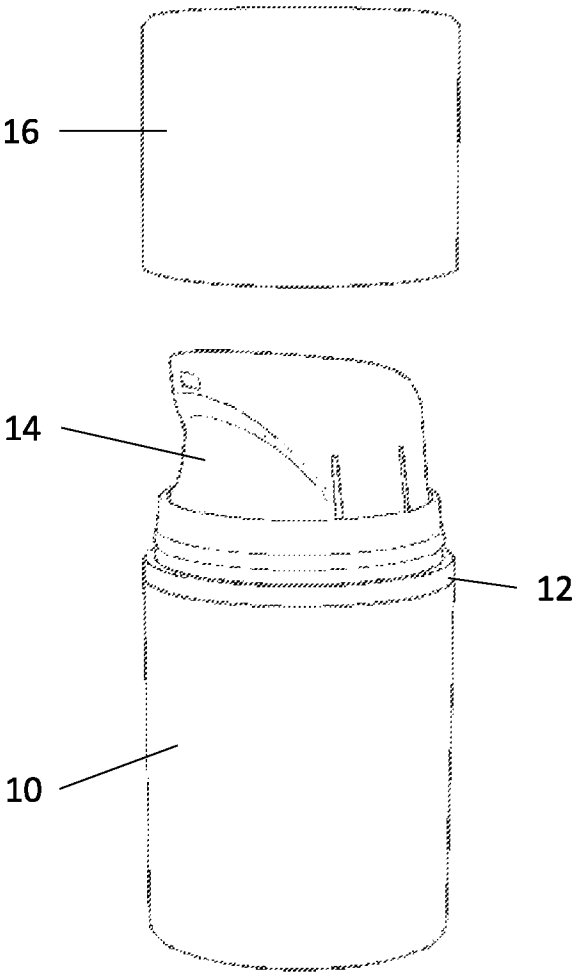
FIG. 1 illustrates an example of a dispenser in accordance with the present invention in assembled form, with its cap removed.

With reference to FIG. 1, the dispenser according to the present invention is comprised of a standard dispenser body 10 containing an aerosol, gel, cream liquid or the like. Disposed on the top of the body is a base 12 and nozzle 14, shown in assembled form. Typically, the dispenser will have a cap or lid 16 that is applied over the nozzle and base.

Figure 2:
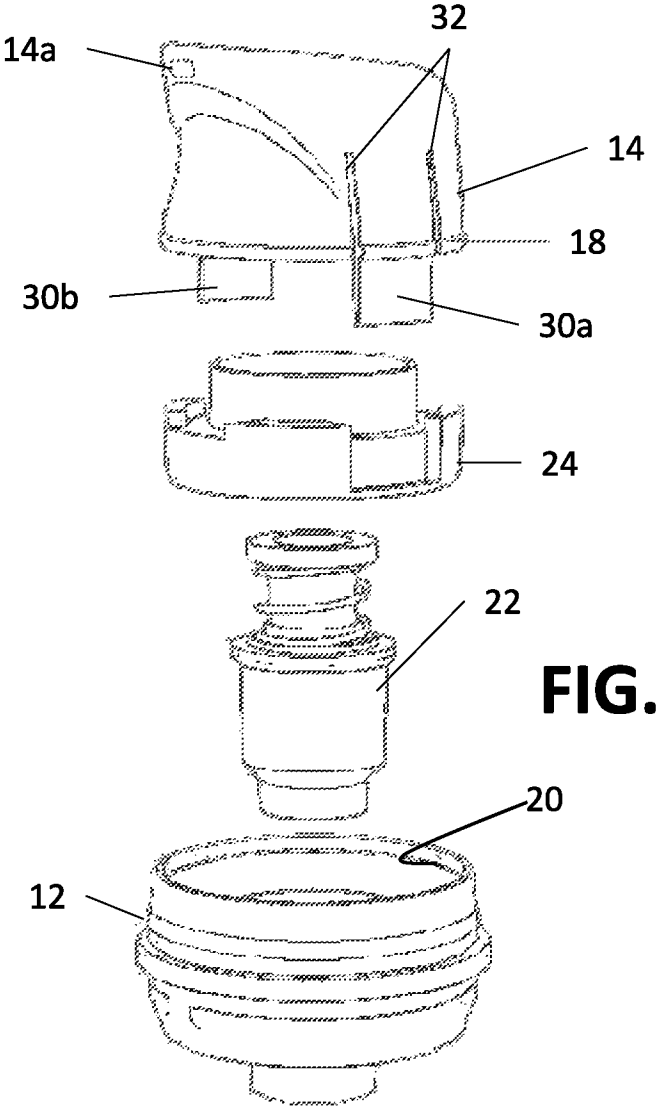
FIG. 2 is an illustration of the components of the base and nozzle assembly of the dispenser of FIG. 1 in exploded form.

FIG. 2 shows, in exploded form, the base and nozzle assembly of FIG. 1. Nozzle 14 has an outlet 14*a* and a slight annular projection or bead 18 that extends radially outward from the lower portion of the nozzle, as shown. Base 12 is provided with a complementary annular projection or bead 20 that extends radially inward. In assembly, the nozzle is forced into the base and clips into place, with the lower surface of the annular bead 20 abutting the upper surface of annular bead 18, thereby capturing the nozzle 14 within the base 12 and preventing it from being removed from the base, while also allowing the nozzle 14 to rotate within the base 12.

Figure 3:
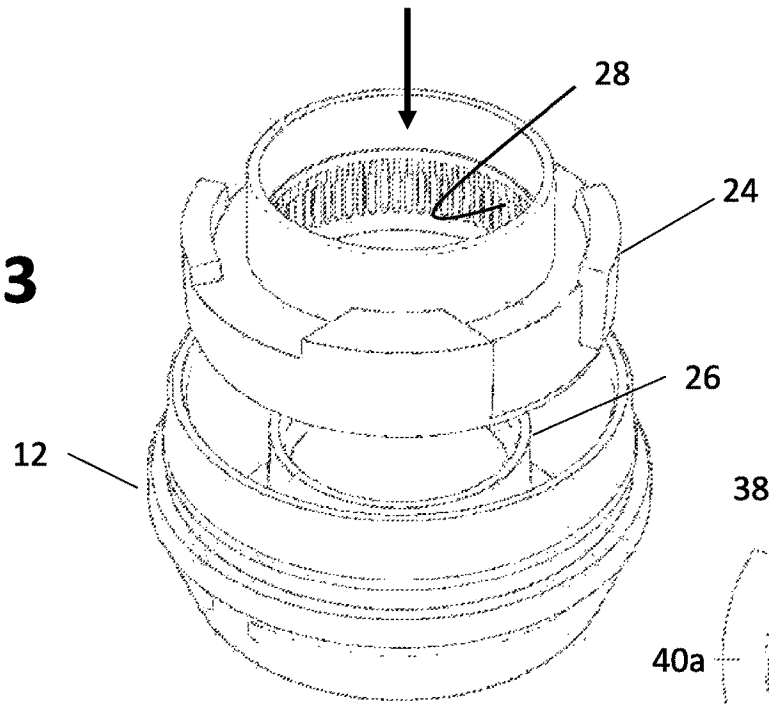
FIG. 3 is an illustration of the deck and base components of the dispenser in accordance with an example of the present invention.

Disposed between the nozzle 14 and base 12 are a standard pump mechanism 22 and a deck 24. As shown in FIG. 3, both the deck 24 and base 12 have a vertically oriented axial bore, as denoted by the arrow, and are axially aligned when the deck 24 is disposed within the base 12 so that the pump mechanism can be located within the bore. The interior of the base 12 is provided with a vertically extending annular rim 26, the outer surface of which is provided with vertically oriented teeth (not shown). The inner bore of the deck 24 is provided with vertically oriented teeth 28 that are complementary to the teeth on the outer surface of the rim 26. When assembled, the teeth 28 on the inner bore of the deck 24 and the outer surface of the rim 26 lock, to thereby prevent the deck 24 from rotating relative to the base 12. Alternatively, the deck 24 and base 12 can be molded, or otherwise formed, as a single, unitary part, in which case the complementary teeth described above would not be necessary.

Figure 4:
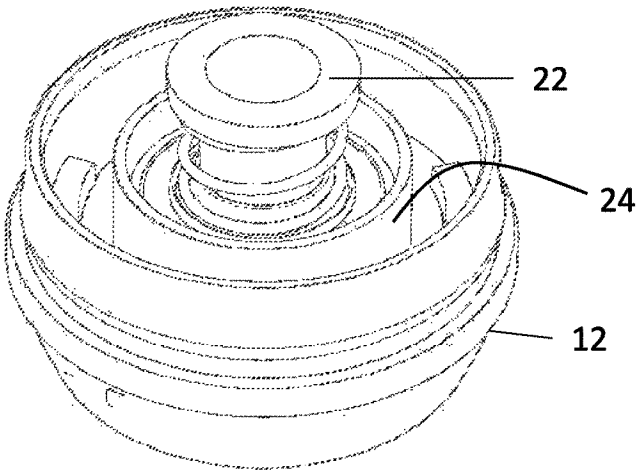
FIG. 4 is an illustration of the dispenser pump disposed within axially aligned bores of the base and deck of FIG. 3.

The pump mechanism 22 is disposed within the axially aligned bores of the base 12 and deck 24 as best shown in FIG. 4. In assembled form, the lower part of the pump 22 is in functional communication with the material inside the body 10 (by means of a siphon or the like, not shown). When the mechanism in accordance with the present invention is unlocked, as will be described, the pump is actuated when the user presses down on the nozzle and the inner top surface of the nozzle 14 bears down upon and vertically displaces the upper part of the pump relative to the lower part. The contents contained in the body 10 are then released through nozzle opening 14*a*, FIG. 2, in a well-known manner.

Figure 3A:
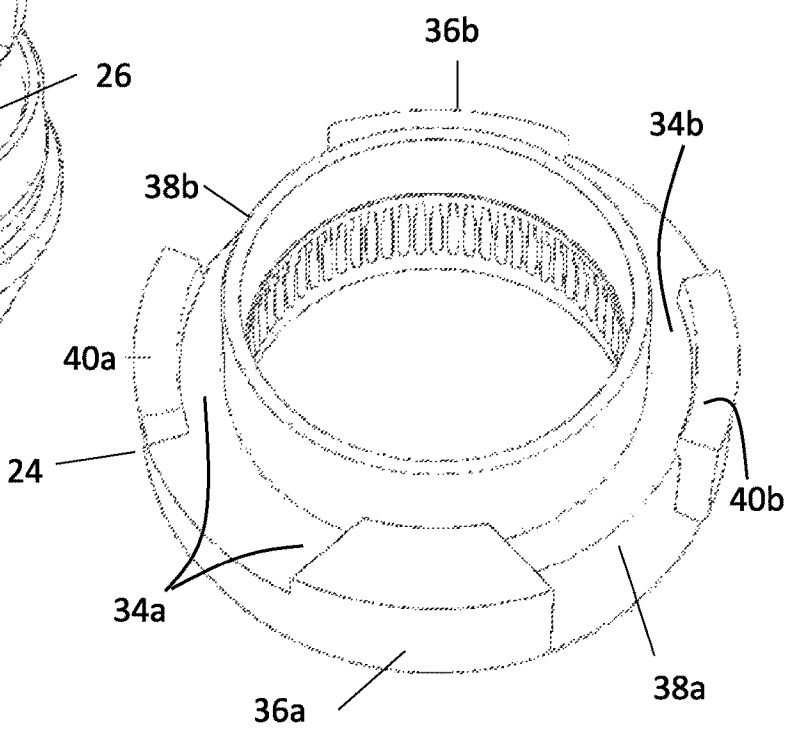
FIG. 3A illustrates details of the deck component of FIG. 3.

As shown in FIG. 2, the nozzle 14 is provided with diametrically opposed tabs 30*a* and 30*b*. The tabs extend downwardly, past the annular bead 18, and can be flexed radially inwardly, which is facilitated by vertical slots 32 on either side of each of the tabs. The tabs 30*a* and 30*b* cooperate with the deck 24 to produce the tamper/child-resistant capabilities of the dispenser in accordance with the present invention. As best shown in FIG. 3A, deck 24 is provided with annular tracks 34*a* and 34*b* on the upper surface of the deck within which the lower portions of the tabs 30*a* and 30*b* can travel as the nozzle rotates relative to the base, as will be described. The track terminates at diametrically opposed stops 36*a* and 36*b*, which prevent the nozzle from further rotation when the tabs 30*a* and 30*b* abut the respective stops. The periphery of the deck 24 is also provided with two diametrically opposed, downwardly extending recesses 38*a* and 38*b*, which are wide enough to accommodate the tabs 30*a* and 30*b*. Finally, diametrically opposed walls 40*a* and 40*b* project from the deck, radially outside the tracks 34*a* and 34*b*, respectively.

Figures 5A, 5B, 5C:
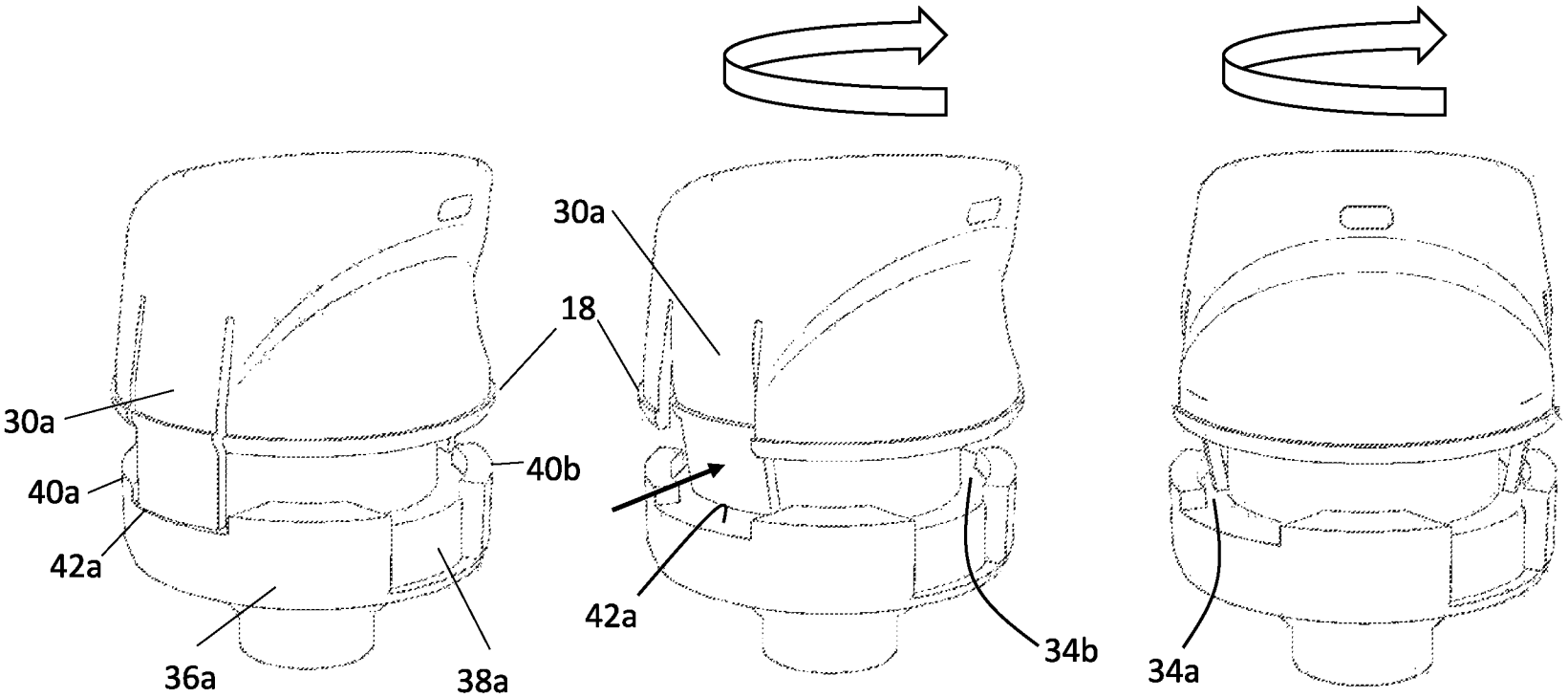
FIGS. 5A-5F illustrate the operation of an example of a dispenser in accordance with the present invention.
Figure 5F:
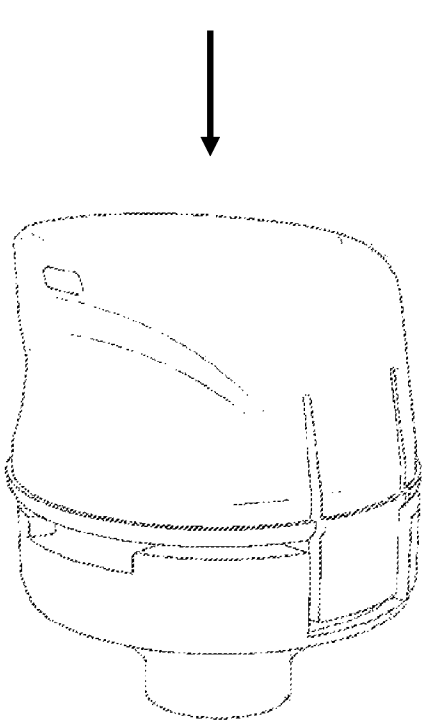
Figure 5E:
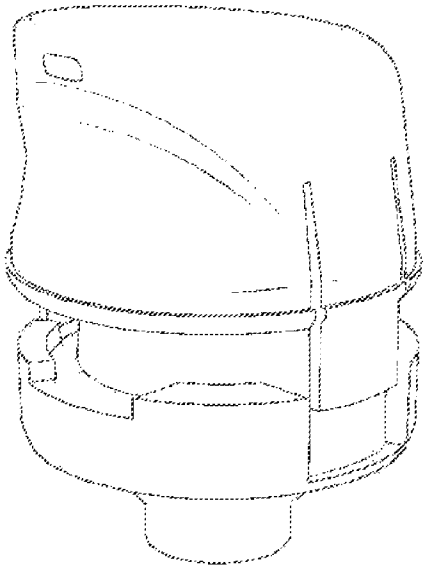
Figure 5D:
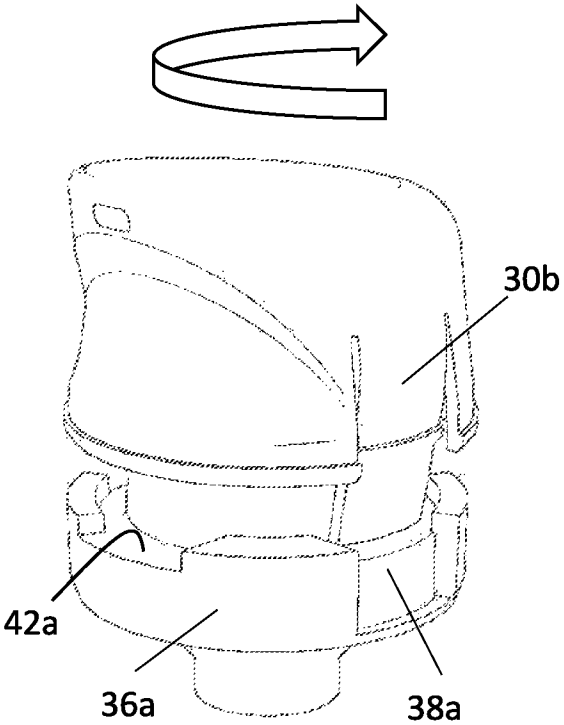

The operation of the invention will be described with reference to FIGS. 5A-5F. It is noted that the portions of the nozzle and deck at and below the annular bead 18 are located inside of the base 12, as shown in FIG. 1, and are not seen by or exposed to the user, but these portions are shown in the figures to assist in the description of the operation. In their relaxed or normal state, the tabs 30*a* and 30*b* are radially aligned with the periphery of the deck, as shown In FIG. 5A. In this position, the tabs 30*a* and 30*b* abut horizontal surfaces 42*a* and 42*b* (not shown) of the deck, which prevents the nozzle from downward movement so that it cannot be actuated. Further, the nozzle cannot rotate relative to the base because the tabs 30*a* and 30*b* abut, on both sides thereof, and are limited by, walls 40*a* and 40*b* and stops 36*a* and 36*b*, respectively. As shown in FIG. 5B, to actuate the nozzle, the user squeezes tabs 30*a* and 30*b* inwardly, as shown by the arrow, so that they are radially aligned with tracks 34*a* and 34*b*, at which point the user can rotate the nozzle clockwise, as shown in FIG. 5C. At this point, the lower ends of tabs 30*a* and 30*b* are held within walls 40*a* and 40*b* and remain on tracks 34*a* and 34*b*. The user continues to rotate the nozzle until the tabs 30*a* and 30*b* abut stops 36*b* and 36*a*, respectively, as shown in FIG. 5D. At this point, the tabs 30*a* and 30*b* are aligned with notches 38*a* and 38*b*, they are released from the walls 40*a* and 40*b*, and they can return to their relaxed or normal state, as shown in FIG. 5E, as the user releases them. At this point, the nozzle 14 is unlocked and the user can depress it, as shown in FIG. 5F, to that it can bear down on the top of the pump 22, to dispense the contents.

It will be understood that various changes in the details, materials and arrangements of parts and steps which have been herein described and illustrated in order to explain the nature of the invention may be made by those skilled in the art within the principle and scope of the invention. For example, the foregoing arrangement uses diametrically opposed pairs of tabs 30*a* and 30*b*, stops 36*a* and 36*b*, and slots 38*a* and 38*b*. However, the present invention can be utilized with a single tab, stop and notch, or more than two tabs, stops or notches, if desired, without departing from the spirt of the invention, as expressed in the following claims.

We claim:

1. A tamper-resistant nozzle assembly for preventing unwanted or unintentional dispensing of a material from a container, comprising:

a. a base adapted to fit on top of said container holding said material;

b. a mechanism located within said base and configured to provide tamper-resistant properties for said nozzle assembly;

c. a nozzle connected to said base and having a pair of diametrically opposed tabs extending downwardly therefrom into said base, said tabs being capable of travelling radially inward when squeezed by a user;

d. whereby i. in a locked state, said mechanism limits the travel of said tabs such that (1) said nozzle cannot rotate relative to said base, and (2) said nozzle cannot be depressed to release said material from said container; and ii. when a user squeezes said tabs, said mechanism is in an unlocked state and permits the rotation of said nozzle relative to said base, said rotation thereby enabling the nozzle to be depressed relative to said base to allow it to dispense said material from said container.

2. The tamper-resistant nozzle assembly of claim 1, wherein said mechanism comprises a. a pair of tracks along which said tabs can travel to rotate said nozzle between said locked and unlocked states, and b. a pair of projections preventing said tabs from travelling along said tracks to prevent said nozzle from rotating from said locked state to said unlocked state.

3. The dispenser of claim 2 wherein said mechanism further includes a pair of notches adapted to allow said tabs to move vertically to thereby allow said nozzle to dispense said material from said container in said unlocked state.

4. The dispenser of claim 1 wherein said mechanism and said base are formed as a single, unitary piece.

5. The dispenser of claim 1 wherein said mechanism and said base are formed as two separate pieces.

6. A tamper-resistant dispenser for preventing unwanted or unintentional dispensing of a material from a container, comprising a. said container for holding said material;

b. a nozzle connected to said container;

c. a pump adapted to be in functional communication with said material and adapted to dispense said material through said nozzle when activated; and d. a mechanism interacting with said nozzle such that, in a first state, said mechanism prevents said nozzle from dispensing said material, and which, in a second state, enables said nozzle to dispense said material by allowing said nozzle to activate said pump;

e. wherein said nozzle includes at least one tab adapted to be engaged by a user to allow said nozzle to rotate from said first state to said second state, said rotation thereby enabling said nozzle to dispense said material.

7. The dispenser of claim 6, wherein said tab is adapted to be pushed radially inward by said user to allow said user to rotate said nozzle between said first and second states.

8. The dispenser of claim 7 wherein said mechanism comprises f. a track along which said tab can travel to rotate said nozzle between said first and second states, and g. a projection preventing said tab from travelling along said track to prevent said nozzle from rotating from said first state to said second state.

9. The dispenser of claim 8 wherein said mechanism further includes a notch adapted to allow said tab to move vertically to thereby allow said nozzle to activate said pump in said second state.

10. The dispenser of claim 6 wherein said nozzle includes a pair of diametrically opposed tabs adapted to be squeezed by said user to allow said nozzle to selectively rotate from said first state to said second state.

11. The dispenser of claim 10 wherein said mechanism comprises h. a pair of tracks along which said tabs can travel to rotate said nozzle between said first and second states, and i. a pair of projections preventing said tabs from travelling along said tracks to prevent said nozzle from rotating from said first state to said second state.

12. The dispenser of claim 11 wherein said mechanism further includes a pair of notches adapted to allow said tabs to move vertically to thereby allow said nozzle to activate said pump in said second state.

* * * * *